US005853032A

United States Patent [19]

Shaw et al.

[11] Patent Number: 5,853,032

[45] Date of Patent: Dec. 29, 1998

[54] LOOM GRIPPER DRIVE WITH APPARATUS FOR CHANGING THE PATH OF MOTION OF THE GRIPPER BAND

[75] Inventors: Henry Shaw, Woesten-Vleteren; Patrick Strubbe, Gistel, both of Belgium

[73] Assignee: Picanol N.V., Ypres, Belgium

[21] Appl. No.: 729,150

[22] Filed: Oct. 11, 1996

[30] Foreign Application Priority Data

Oct. 11, 1995 [BE] Belgium ..... 9500840

[51] Int. Cl.[6] ..... D03D 47/12

[52] U.S. Cl. ..... 139/449

[58] Field of Search ..... 139/449

[56] References Cited

U.S. PATENT DOCUMENTS

| | | | |
|---|---|---|---|
| 3,232,321 | 2/1966 | Dewas | 139/449 |
| 4,427,037 | 1/1984 | Hill | 139/449 |
| 4,526,212 | 7/1985 | Mazzini | 139/449 |
| 4,726,402 | 2/1988 | Oppl | 139/449 |
| 4,844,132 | 7/1989 | Cinel et al. . | |

FOREIGN PATENT DOCUMENTS

| | | | |
|---|---|---|---|
| 0 077 087 | 4/1983 | European Pat. Off. . | |
| 0 292 965 A1 | 12/1988 | European Pat. Off. . | |
| 1105603 | 4/1902 | France | 139/449 |
| 75 20194 | 1/1977 | France . | |
| 26 28 067 | 1/1977 | Germany | 139/449 |

*Primary Examiner*—Andy Falik
*Attorney, Agent, or Firm*—Bacon & Thomas

[57] ABSTRACT

A loom gripper band driving device includes apparatus for changing the path of motion of the gripper band. The drive device includes a band driving wheel connected to a gear that engages a gear segment pivotable about a fixed support shaft and that is connected by a coupling rod to a crank arm that pivots about a fixed crankarm supporting shaft. The coupling rod is connected at its opposite ends to the gear segment and the crankarm, respectively, with the connecting points between the coupling rod, gear segment and crankarm being variable to change the path of motion of the gear segment and the gripper drive relative to the crankarm and in particular the crankarm supporting shaft.

12 Claims, 4 Drawing Sheets

FIG. 6
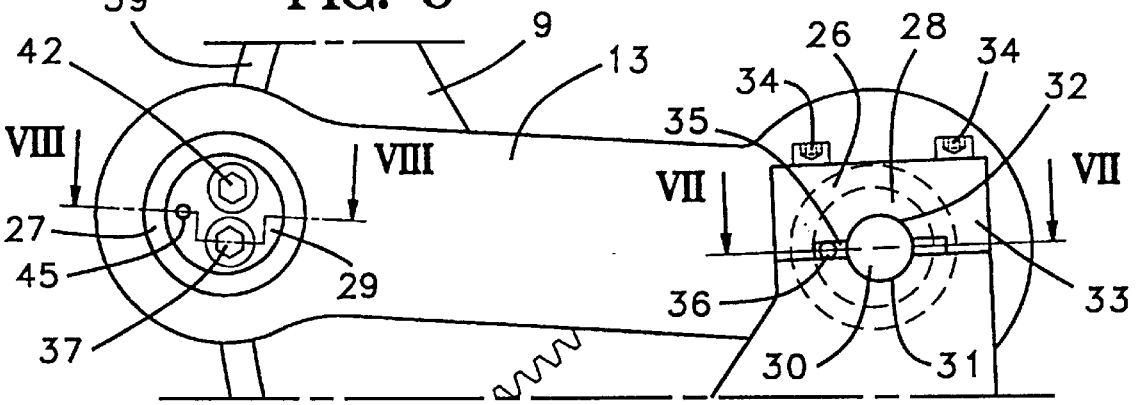
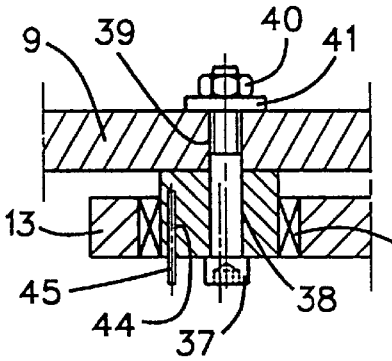
FIG. 8
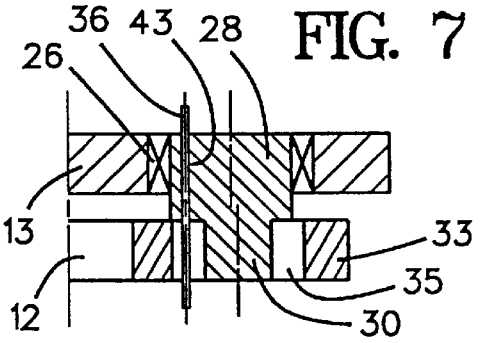
FIG. 7
FIG. 3
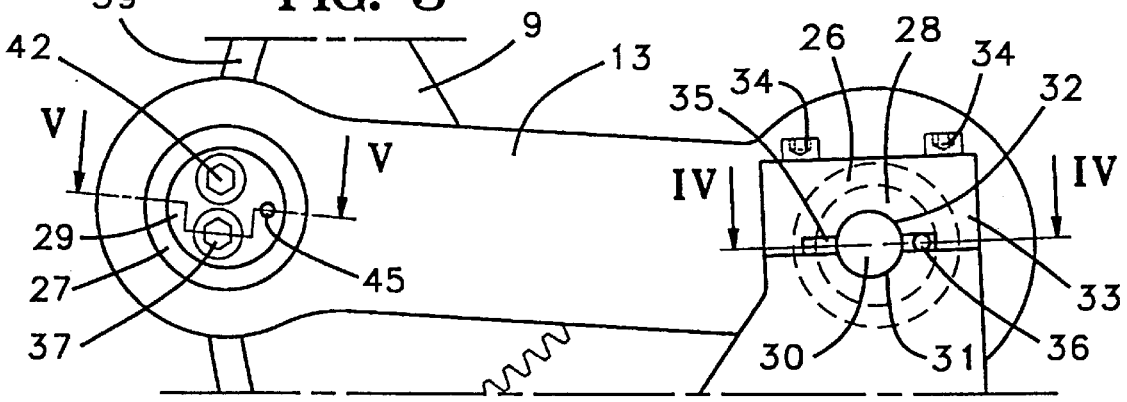
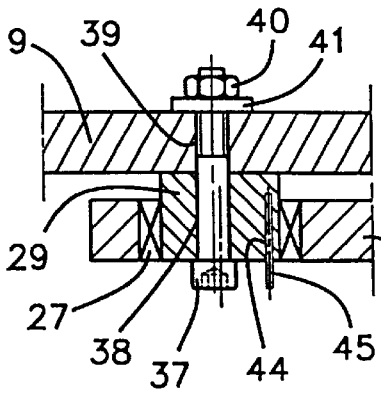
FIG. 5
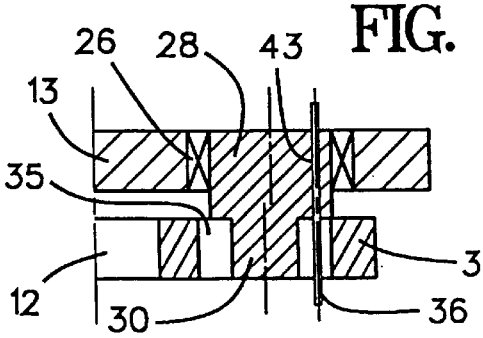
FIG. 4

LOOM GRIPPER DRIVE WITH APPARATUS FOR CHANGING THE PATH OF MOTION OF THE GRIPPER BAND

BACKGROUND OF THE INVENTION

A. Field of the Invention

The invention concerns a loom gripper-drive comprising a wheel driving a gripper band, said wheel being operationally linked to a gear segment supported on a stationary shaft and connected by a crankrod to a crankarm resting on a stationary shaft, said crank rod being connected by one connecting site each to the gear segment and to the crankarm at a distance from the particular stationary shafts.

B. Discussion of the Related Art

A gripper drive of the initially cited kind is known for instance from the European patent document A 077,087. The gripper band bearing a gripper at one of its ends is driven by a wheel. To transmit the drive motion to the gripper band, the wheel may be fitted with teeth engaging apertures in the gripper band. Moreover the end of the gripper band opposite the end with the gripper may be affixed to the wheel. Again said end may be fastened to the wheel and also the drive mechanism may be implemented additionally by means of the apertures in the gripper band. The wheel is driven in both directions by a rocking gear segment, with provision of force-transmitting elements comprising at least one gear linked to the wheel. The gear segment is driven by a rocking crankarm linked by a coupling rod to the gear segment. In the design of the European patent document A 077,087 the crankarm is made to rock by a three-dimensional gear unit. However a cam drive such as is illustratively known from the French patent document A 23 15 558 also may be used to drive the crankarm.

In order to make the magnitude of displacement of the gripper band and hence of the gripper adjustable, such designs provide that the coupling rod be connected at different radial spacings from the axis of the gear segment or from the axis of the crank- arm. In the design of the French patent document A 23 15 558 or of the European patent document A 077,087 the coupling rod is connected at a fixed position relative to the crankarm whereas the connection of the crankrod to the gear segment is adjustable. The connection site can be constrained by a slot guide in the gear segment. This slot guide is such that in one of the end positions (end of travel positions) of the gripper band and hence of the gripper the slot guide extends approximately circumferentially relative to the connection point or location of the crankarm. Thereby it is possible to adjust the position of the connection point of the coupling rod to the gear segment without thereby changing the associated end position of the gear segment and hence of the gripper band and gripper. The motion of the gripper band and hence of the gripper might be somewhat affected by changing the magnitude of displacement of the gripper band and hence of the gripper. However to substantially change the motion of a gripper band and of the gripper mounted on it, the crankarm must be driven by an altered three-dimensional gear unit or an altered cam drive. Such alterations are costly.

BRIEF SUMMARY OF THE INVENTION

The object of the invention is to so design a gripper drive of the initially cited kind wherein a change in the path of the motion of the gripper band and hence of the gripper is possible without the need for altering the crankarm drive.

This problem is solved by means for circumferentially adjusting the position of the connection point or location of the coupling rod to the crankarm relative to the stationary shaft of the crankarm.

By circumferentially adjusting the position of the connection point or location of the coupling rod to the crankarm, the time function of the motion of the gripper band and gripper may be varied without altering the drive system of the crankarm and without the need to install and remove parts.

In a further embodiment of the invention, the connecting point of the coupling rod to the gear segment contains means for varying the distance between the two connection point to compensate for a change of the position that was set for the connection point at the crankarm. Thereby a change in position of the connection point of the coupling rod to the crankarm is reliably precluded from entailing a change in one of the end positions of the gear segment and as a result the end adjustment of the gripper band and gripper associated with this end position also shall be preserved.

In an advantageous embodiment of the invention, the coupling rod is supported on a shaft mounted on the crankarm, where said shaft is affixable in at least two different positions relative to the crankarm. In a simple design, the shaft is mounted excentrically relative to a journal which is affixable in a mount of the crankarm. Thereby the shaft can be adjusted in at least two positions by rotating the journal, and said positions entail different circumferential positions relative to the stationary shaft of the crankarm.

In a further embodiment of the invention, the coupling rod is mounted on a shaft affixed to the gear segment for the purpose of compensating for a change in the distance between the connection sites when adjusting the connection site of the coupling rod to the crankarm, said shaft being affixable in at least two circumferentially different positions relative to the stationary shaft on the gear segment. In an advantageous embodiment, the shaft is located excentrically relative to the fasteners affixing it to the gear segment.

DESCRIPTION OF THE DRAWINGS

Further advantages and features of the invention are elucidated in the following description of illustrative embodiments shown in the drawings.

FIG. 3 is a detail F3 of FIG. 1 on a larger scale, FIG. 4 is a partial section along line IV—IV of FIG. 3, FIG. 5 is a partial section along line V—V of FIG. 3, FIG. 6 is the detail F3 of FIG. 1 corresponding to FIG. 3 in another adjustment, FIG. 7 is a partial section along line VII—VII of FIG. 6, FIG. 8 is a partial section along line VIII—VIII of FIG. 6.

DETAILED DESCRIPTION OF PREFERRED EMBODIMENTS OF THE INVENTION

Figure 1:
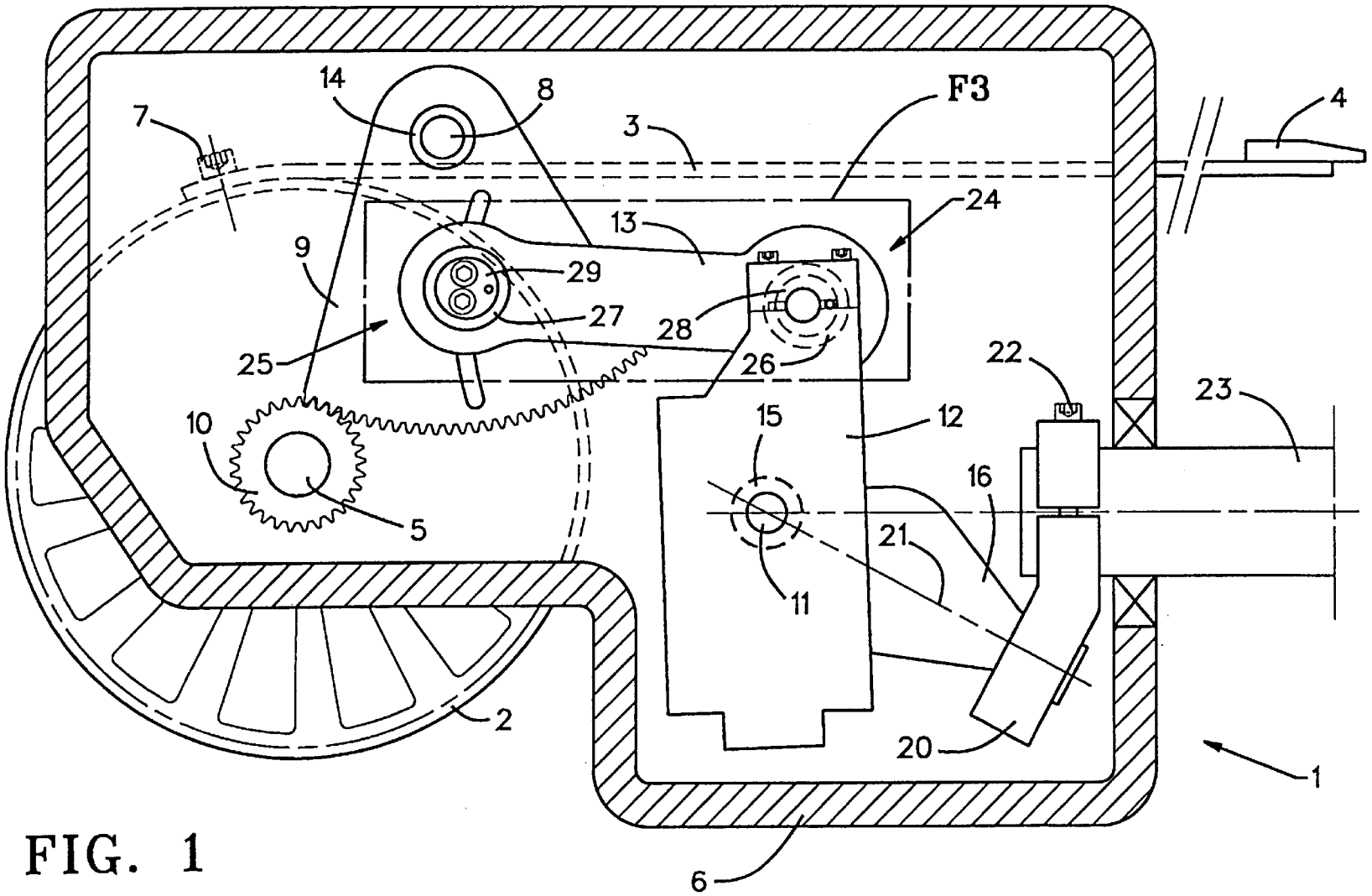
FIG. 1 is partial sectional elevation of a gripper drive of the invention in a first end position.
Figure 2:
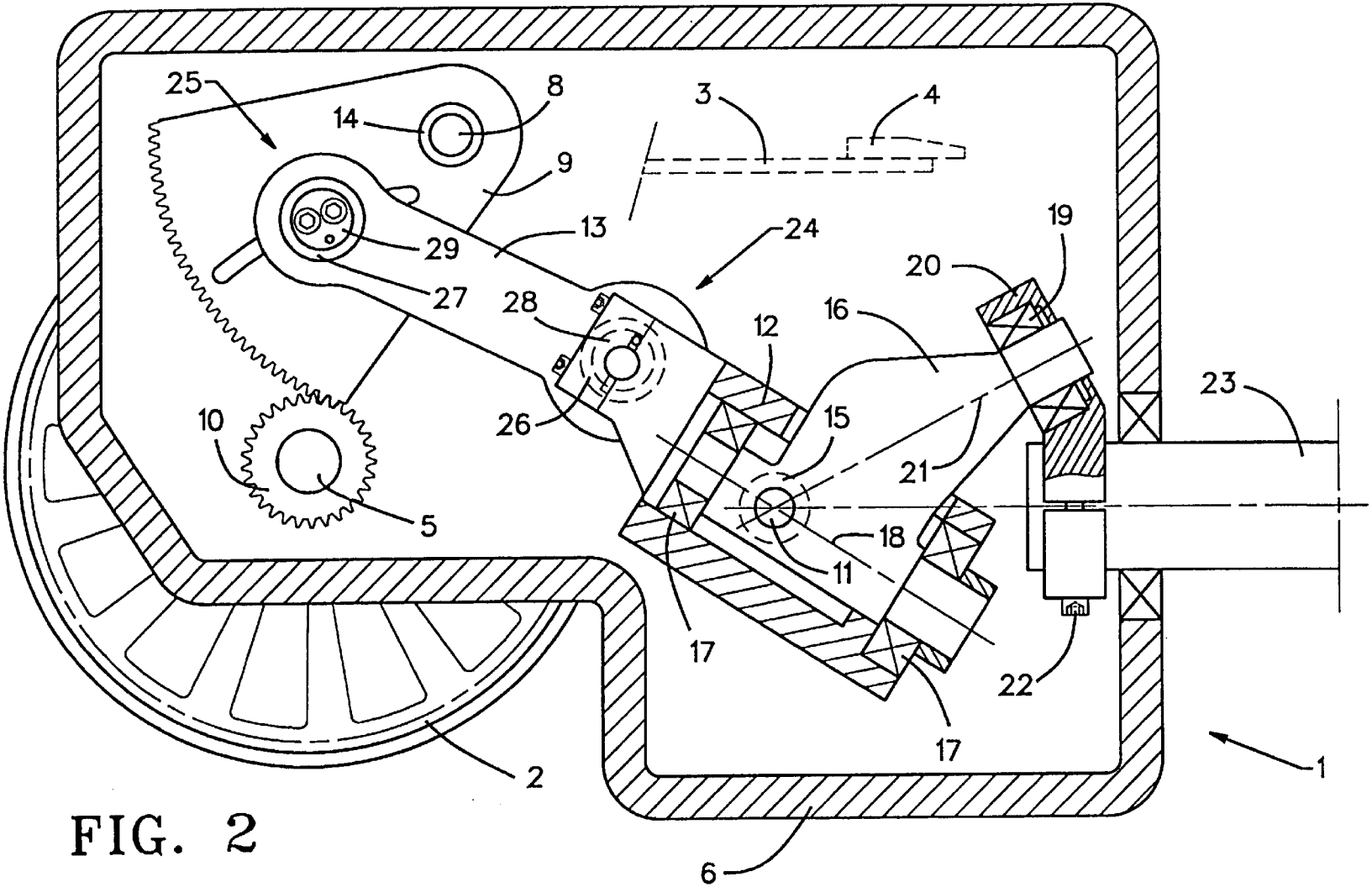
FIG. 2 is the gripper drive of FIG. 1 in another end position.

The gripper drive 1 of FIGS. 1 and 2 comprises a wheel 2 driving a gripper band 3 at the end of which is affixed a gripper 4. The wheel 2 is mounted on a shaft 5 supported on bearings in a manner not shown in further detail in a housing 6 of the gripper drive. The gripper-band end opposite the gripper 4 is affixed by a screw 7 to the circumference of the wheel 2. Moreover the wheel 2 is fitted on its circumference with teeth (not illustrated) cooperating with apertures (also not shown) in the gripper band 3.

The wheel 2 is driven in both directions by a gear segment 9 rocking about a stationary shaft 8. By its teeth the gear segment 9 engages a gear 10 which is irrotationally mounted on the shaft 5 of the wheel 2. In turn the gear segment 9 is driven by a crankarm 12 rocking about a stationary shaft 11. The gear segment 9 and the crankarm 12 are linked to each other by a coupling rod 13 and as a result the rocking motion of the crankarm 12 is converted into rotational motion of the wheel 2. The stationary shaft 8 of the gear segment 9 is supported by a bearing 14 and the stationary shaft 11 of the crankarm 12 is supported by a bearing 15 in the frame 6 of the gripper drive 1. The shafts 8 and 11 run mutually parallel. Also the shaft 5 of the wheel 2 is parallel to the shafts 8 and 11.

The crankarm 12 comprises an essentially cylindrical and hollow housing fitted on the outside with two mutually opposite shaft-stubs forming the shaft 11. A drive element 16 is rotatably supported inside the housing of the crankarm 12 by two bearings 17. The shaft 18 runs in a plane perpendicular to the shaft 11 and intersects this shaft 11. The drive element 16 rests by means of a bearing journal forming a shaft 21 in a bearing 19 of an elbowed element 20. The elbowed element 20 is affixed by fasteners 22 to a drive shaft 23. The axes of the shafts 11, 18, 21 and the axis of the drive shaft 23 intersect at a common point in the axis of the shaft 11. In a first embodiment, the drive shaft 23 is driven by a main shaft (not shown) of the loom constituting the batten drive. In another embodiment the drive shaft is powered by its own drive motor running synchronously with the loom main shaft.

The coupling rod 13 is connected by a connection point or location 24 to the crankarm 12 and by a connection point or location 25 to the gear segment 9. The connection point or location 24 is radially displaced relative to the shaft 11 and the connection point 25 is located at a radial and adjustable distance from the shaft 8. The shafts 8 and 11 are located on either side of the coupling rod 13. In one extremity of motion as shown in FIG. 1, whereat the gripper 4 is at its maximum advanced position, the coupling rod 13 extend approximately tangentially relative to the shaft 11 of the crankarm 12. In the other extremity of motions as shown in FIG. 2 whereat the gripper is maximally retracted, the coupling rod 13 extends approximately radially relative to the shaft 11 of the crank arm 12. The coupling rod 13 is connected by a bearing 26 on a shaft 28 affixed to the crankarm 12. In the vicinity of the connection point 25 at to the gear segment 9, the coupling rod 13 is mounted by a bearing 27 disposed on a shaft 29.

As more clearly shown by FIGS. 3 and 4, the shaft 28 is fitted with a journal 30 having an outer portion that is circumferentially excentric relative to the axis of the shaft 28. The shaft 28 is affixed by this journal 30 to the crankarm 12. The journal 30 is mounted between two bearing pillows 31 and 32 so that it cannot rotate. The bearing pillow 31 is a component of the crankarm 12 whereas the bearing pillow 32 is a component of a fastening means 33 mounted on the crankarm 12. This fastening means 33 is affixed by two screws 34 to the crankarm 12, as a result of which the journal is clamped between the bearing pillows 31 and 32. A clearance 35 is present in the fastening means 33 on either side of the bearing pillow 32 and cooperates with a pin 36. The pin 36 is inserted into a borehole 43 in the shaft 28 on the excentric portion of the shaft 28. This pin increases the reliability that the shaft 28 is irrotationally linked to the crankarm 12 and also indicates the position of the excentricity.

As shown particularly clearly in FIGS. 3 and 5, the shaft 29 is irrotationally affixed to the gear segment 9. One screw 37 extends inside a borehole 38 through the shaft 29 and through a slot guide 39 in the gear segment 9 and receives a nut 40. If desired a lock washer 41 to keep the shaft 29 clamped against the gear segment 9 may be provided. Preferably, however, the shaft 29 shall be secured by another screw 42, in addition to the screw 37, to the gear segment 9 because this screw 42 passes through another borehole in the shaft 29 and through the guide slot 39 in the gear segment 9 and also receiving a nut 40 and a lock washer 41. Using two screws 37 and 42 increases the reliability of the shaft 29 being irrotationally affixed to the gear segment 9. Further and has an outer portion that is circumferentially excentric relative to axis or its axis or the center of the fastening means, that is, relative to the center of the guide slot 39 between the two screws as shown especially clearly in FIGS. 3 and 5, the shaft 29 37 and 42. On the side of its excentricity, the shaft 29 includes a borehole 44 for receiving a pin 45, whereby the position of the excentricity is easily noticed The connection point 25 of the coupling rod 13 at the gear segment 9 is adjustable along the slot guide 39 by loosening and tightening the screws 37 and 42. The excursion of the gripper motion is adjustable by adjusting the radial distance of the connection point 25 to the shaft 8 of the gear segment 9. As shown by FIG. 1, the slot guide 39 in the gear segment 9 runs or extends essentially circumferentially about the shaft 28 in the end position whereat the gripper 4 is at its deepest in the shed, the coupling rod 13 on the crank arm 12 being rotatable about this shaft 28. Accordingly adjustment of the distance of the connection site 25 to the shaft 8 of the gear segment 9 does not entail alteration of the position of the gear segment and hence does not entail alteration of the end position of the gripper 4.

The above described gripper drive 1 allows arranging the shafts 28 and 29 in different positions so that, regardless of the drive for the crankarm 12, another path may be set for the gripper and this without the need to exchange parts of the gripper drive 1. The shafts 28 and 29 each can be moved and affixed into positions shifted by 180°, the excentricity of the shaft 28 in one case being located on the connecting line from the shaft 11 to the journal 30 between shaft 11 and channel 30 and in the other case on the other side thereof. The excentricity of the shaft 29 also may be located on the connecting line from the shaft 8 to the middle of the slot guide 39 at the connection point 25 shaft 8 and the middle of slot guide 39, or on the other side thereof. Relative to the coupling rod 13, the shafts 8 and 11 are on opposite sides. Further the position of the connection point 24 is variable by twice the excentricities of the shaft 28 and the journal 30, whereby the difference in excursion of the gripper motion between the settings of FIG. 3 or FIG. 6 is comparatively large.

A first of the two possible positions is shown in FIGS. 1 through 5, whereas a second position is shown in FIGS. 6 through 8. In order to move the shaft 28 out of the position of FIG. 3 into the position of FIG. 6, the following steps are carried out. The screws 34 are loosened. The pin 36 is pulled out of the borehole 43 in the shaft 28. The shaft 28 is rotated about the journal 30 by about 180° whereby the borehole 43 again becomes visible in the clearance 35. The pin 36 is reinserted into the borehole 43. The screws 34 are retightened. However the screws 34 may be fully loosened and be removed together with the fastening means 33, whereafter the shaft 28 is rotated by about 180° about the journal 30 until the pin 36 rests against the crankarm 12. Thereafter the fastening means 33 is installed again and the screws 34 are retightened. In order to move the shaft 29 out of the position shown in FIG. 3 into the position shown in FIG. 6, the nuts 40 of the screws 37 and 42 are loosened. The nut 40 and the washer 41 of the screw 42 are removed, and thereupon the screw 42 is pulled out of the borehole 38. Next the shaft 29 is rotated about the screw 37 by about 180° until the borehole 38 for the screw 42 becomes visible again in the slot guide 39. The screw 42 is reinserted into the borehole 38 and through the slot guide 39, and then the lock washer 41 and the nut 40 are placed back on the screw 42. Then the nuts of the screws 37 and 42 are retightened once the screw 37 and/or the screw 42 have been shifted in the desired manner along the slot guide 39.

If, with respect to the end position shown in FIG. 1 whereat the gripper 4 is located deepest in the shed, the positions of the shafts 28 and 29 are altered from the settings of FIG. 3 the settings of FIG. 6, then the position of the gear segment 9 will practically remain unchanged. As regards a loom in which grippers 4 driven by gripper drives 1 are inserted from both sides into the shed, and said grippers pass a filling yarn in the middle of the shed from one the other, then the transfer position of the grippers will not be changed or nearly not. For that purpose the excentricities of the shafts 28 and 29 are at least approximately equal.

Figure 9:
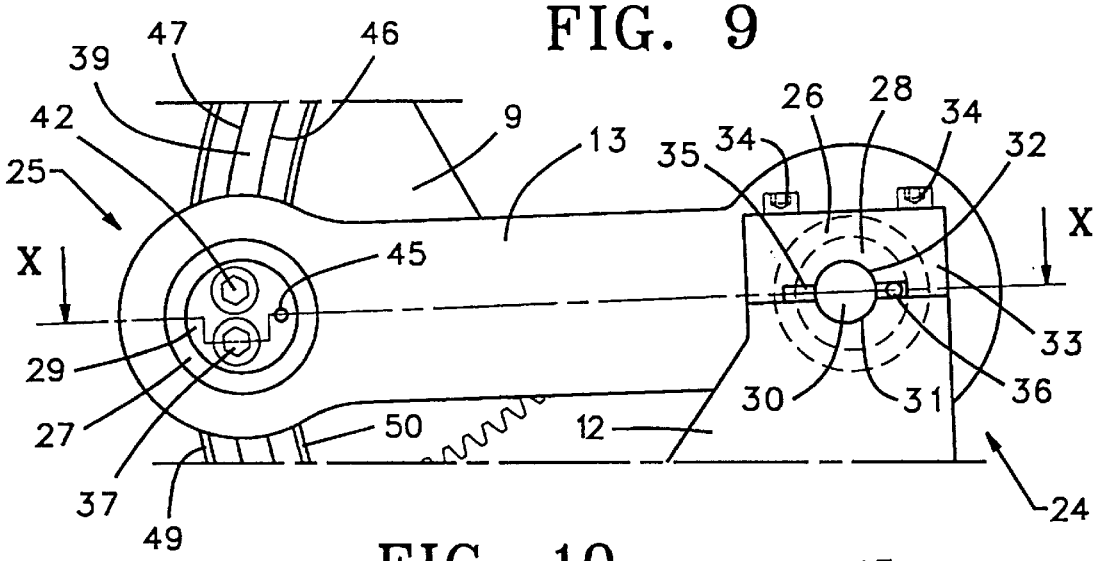
FIG. 9 is a detail similar to FIG. 3 of an embodiment variation.
Figure 10:
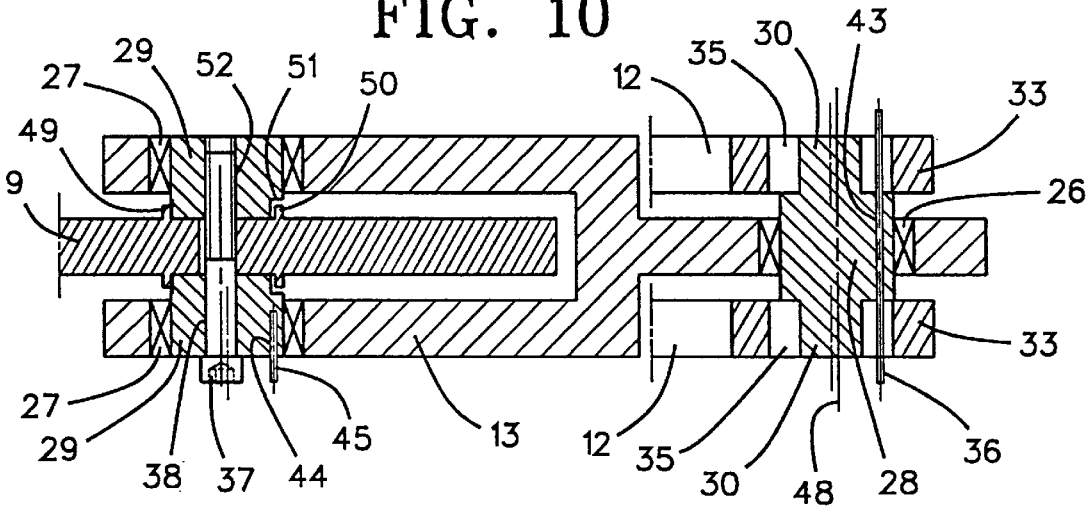
FIG. 10 is a section along line X—X of FIG. 9.
Figure 11:
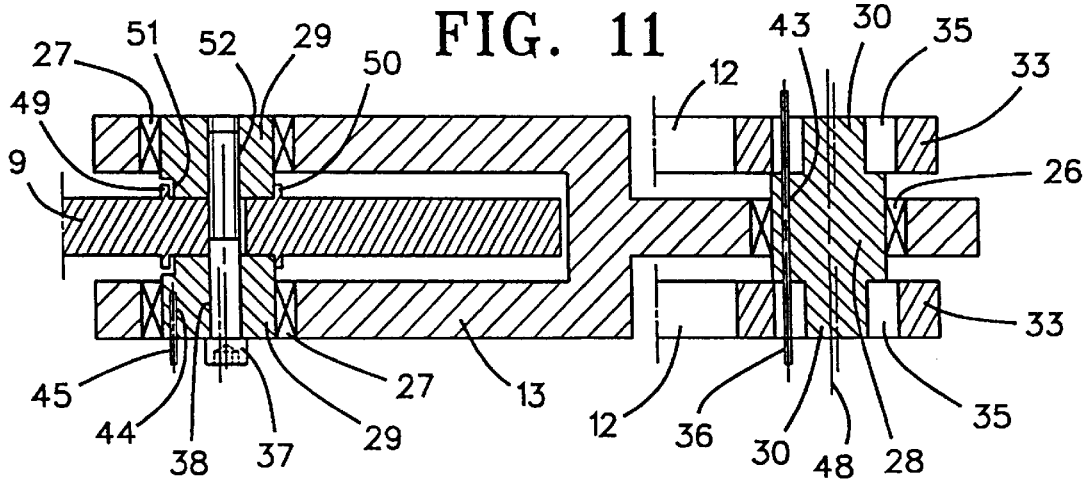
FIG. 11 is a section similar to FIG. 10 for an altered adjustment.

In the embodiment of FIGS. 9 through 11 the shaft 28 is fitted with two mutually opposite excentric journals 30 which are affixable in a forked end of the crankarm 12. Accordingly the design includes two fastening screws 34, bearing pillows 31 and 32 and a total of four screws for the purpose of irrotationally fastening the shaft 28 at both journals 30 to the crankarm 12. The other end of the coupling rod 13 is forked and is supported on two shafts 29 mutually opposite the gear segment 9 to which they are irrotationally fastened by screws 37 and 42. One of the shafts 29 is fitted with boreholes 38 for the screws 37 and/or 42 in relation to the embodiments of FIGS. 1 through 8 whereas the second shaft 29 is fitted with threads 52 into which are screwed the screws 37 and/or 42. According to the embodiment of FIGS. 1 through 8, both shafts 28 and 29 of the embodiment of FIGS. 9 through 11 always can be mounted and affixed in two different positions in the crankarm 12 and in the gear segment 9 respectively in the manner shown by FIGS. 10 and 11.

In the embodiment of FIGS. 9 through 11 the edges 46 and 47 of the guide slot 39 of the gear segment do not extend at the same distance from one another. When the crankarm 12 is in the end position of FIG. 1, the edge 46 extends concentrically with the axial line 48 of the shaft 28 if the shaft is in the position shown in FIG. 10 whereat the excentricity is located on the side away from the gear segment 9. On the other hand the edge 47 of the slot guide 39 extends concentrically with the axial line 48 of the shaft 28 if this shaft is in the position shown in FIG. 11. Collars 49 and 50 are located in the vicinity of the guide slot 39 and cooperate with the outer (excentric) contour of the shafts 29, which includes a recess 51 on their excentric side. The collar 49 extends concentrically with the edge 46 of the slot guide 39 whereas the collar 50 extends concentrically with the edge 47 of the slot guide 39. As regards the setting shown in FIG. 9, the shanks of the screws 37 and 42 are guided along the edge 46 of the slot guide 39 and the shafts 29 are guided along the collar 49. As regards the setting of the shafts 29 according to FIG. 11, the shanks of the screws 37, 42 are guided at the edge 47 of the slot guide 39 and the shafts 29 are guided at the collar 50. Therefore adjusting the distance between the connection point 25 and the shaft 8 of the gear segment 9 will not entail changing the position of the gear segment.

When the coupling rod 13 is relatively long and the slot guide 39 is relatively short, the possible difference regarding the path of the edges 46 and 47 of the slot guide is of the order of magnitude of the required play for the screws 37 and 42 inside the slot guide 39. In this case a slot guide 39 having edges 46 and 47 with constant mutual spacing will be used.

As regards a loom with two grippers each being inserted from opposite sides into the shed, the function of one gripper drive 1 is to move the filling by means of one gripper from the entry to the shed until its middle, whereas the second gripper drive 1 together with the second gripper 4 must accept the filling in the middle of the shed and move it to the opposite side. So-called positive grippers which are opened by external opening elements may be opened to accept or transfer a filling, or so-called negative grippers may be used which need not mandatorily be opened to accept or transfer a filling.

The crank arm 12, the coupling rod 13 and the gear segment 9 of the gripper drive 1 form a rod transmission system converting the motion of the crank arm 12 into a motion of the gear segment 9. This rod transmission contains a virtual drive rod (connecting line between the shaft 11 and the axial line 48 of the shaft 28), virtual intermediate rod (connecting line of the axial line 48 of the shaft 28 and the axial line of the shaft 29) and virtual output rod (connecting line between the shaft 29 and the shaft 8). The displacement path of a gripper moved by such a gripper drive 1 can be calculated using known kinematic equations. When the shafts 28 and 29 each are affixed in different positions on the crankarm 12 and on the gear segment 9, then each time a different rod transmission system will result which will impart a different displacement path to the gear segment 9 and hence to the gripper 4. If the shafts 28 and 29 are mounted in a position as shown in FIG. 3 or FIG. 10 and the gripper drive moves from the end position shown in FIG. 2 to the end position shown in FIG. 1, then the gripper 4 will comparatively quickly acquire a predetermined speed. Therefore such a gripper drive 1 may be well applicable to a negative gripper. On the other hand if the gripper drive 1 moves out of the position shown in FIG. 2 and the shafts 28 and 29 are fastened in a position as shown in FIG. 6 or to FIG. 11, then the gripper 4 will more slowly acquire the predetermined speed and as a result a gripper drive 1 so adjusted is advantageously applicable to a positive gripper.

As regards an embodiment variation, the crankarm 12 is driven, not by a three-dimensional transmission, but by a lifter transmission such as is illustratively described in the French patent document A 23 15 558. In other embodiment modes the crankarm 12 is driven by a cam transmission or by a rod transmission.

In the embodiments described above and shown in the drawings, the connection point 24 of the coupling rod 13 at the crankarm 12 may be located in two different circumferential positions relative to the stationary shaft 11 of the crankarm 12 in such manner that the shaft 28 by means of which the coupling rod 13 rests on the crankarm 12 shall be excentric relative to the journal by means of which the shaft is affixed to the crankarm 12. If it is desired that the connection point 24 be affixable to the crank arm in several different settings on the crank arm 12, then other affixation methods must be provided correspondingly for the shaft 28, where said shaft 28 then no longer need be excentric to its affixation means (journal 30). Illustratively the shaft 28 may be mounted on a mount which is adjustable and affixable in a guide concentric with the shaft 11 of the crankarm 12.

The illustrative embodiments serve a merely didactic function and do not limit the scope of protection which is exclusively determined by the claims.

We claim:

1. A loom gripper-drive (1) including a wheel (2) drivingly connected to a gripper band (3), said wheel (2) being drivingly connected to a movable gear segment (9) supported on a first stationary shaft (8) and connected by a coupling rod (13) to a crankarm (12) supported on a second stationary shaft (11), said coupling rod (13) being connected at respective connection points(24,25), to the gear segment (9) and to the crankarm (12) at respective distances from the first and second stationary shafts (8,11), and means (28,30) for adjusting the circumferential position of the connection point (24) of the coupling rod (13) to the crankarm (12) relative to the second stationary shaft (11).

2. Gripper-drive as claimed in claim 1, wherein the connection of the coupling rod (13) to the gear segment (9) comprises means (29,37,42; 39,46,47,49,50,51) permitting compensation for a change in the distance between the respective connection points (24,25) connecting the coupling rod (13) to the gear segment (9) and to the crankarm (12) resulting from a change in the set position of the connection point (24) of the coupling rod (13) to crankarm (12).

3. Gripper-drive as claimed in claim 1, including a crankarm shaft (28) mounted on the crankarm (12) and affixable in at least two different position relative to the crankarm (12) and wherein the coupling rod (13) is supported on the crankarm shaft (28).

4. Gripper-drive as claimed in claim 3, including a journal (30) affixable in a mount (31,32) of the crankarm (12), and wherein the crankarm shaft (28) has at least a portion extending eccentrically in a circumferential sense relative to the journal (30).

5. Gripper-drive as claimed in claim 4, including a gear segment shaft (29) affixed to the gear segment (9) and wherein the coupling rod (13) is connected to said gear segment shaft (29), said gear segment shaft (29) being adjustment so as to be disposed at least two circumferentially different positions relative to the said first stationary shaft (8).

6. Gripper-drive as claimed in claim 5, including fastening means (37,42,39) affixing said gear segment shaft (29) to the gear segment (9) and wherein the gear segment shaft (29) includes a portion that is circumferentially eccentric relative to said fastener means.

7. Gripper-drive as claimed in claim 6, including a slot guide (39) in the gear segment (9) and including means for guiding the gear segment shaft (29) in the slot guide (39) and for securing the gear segment shaft (29) against rotation.

8. Gripper-drive as claimed in claim 7, wherein the crankarm shaft (28) and gear segment shaft (29) are fitted with means (36; 37,42) to irrotationally secure their preset positions.

9. Gripper-drive as claimed in claim 1, wherein the first and second stationary shafts (8,11) are located on mutually opposite sides relative to a virtual connecting line extending between the connection points (24,25) connecting the connecting rod to the gear segment (9) and the crankarm (12).

10. Gripper-drive as claimed in claim 9, wherein the coupling rod is moveable between extremities of motion, and wherein at one extremity of motion of the coupling rod (13), the coupling rod (13) extends nearly tangentially to the second stationary shaft (11) and at an opposite extremity of motion of the coupling rod (13), the coupling rod (13), the coupling rod extends nearly radially to the second shaft (11).

11. Gripper-drive as claimed in claim 7, wherein said gear segment is moveable between extremities of motion and wherein the slot guide (39) comprises guides (46,47) for the fastening means (37,42) of the gear segment shaft (29), said guides (46,47) extending essentially concentrically with the crankarm shaft (28) when the gear segment (9) is located at one of its extremities of motion.

12. Gripper drive as claimed in claim 11, wherein the gear segment (9) is fitted with two pairs of guides (46,49; 47,50) cooperating with the fastening means (37,42) of the gear segment shaft (29) of which one pair of guides (46,49) extends essentially concentrically with the crankarm shaft (28) when said crankarm shaft (28) is in a first position and of which the other pair (47,50) extends essentially concentrically with the crankarm shaft (28) when the said crankarm shaft (28) is in a second position.

* * * * *